US009747921B2

(12) United States Patent
Niwa et al.

(10) Patent No.: US 9,747,921 B2
(45) Date of Patent: Aug. 29, 2017

(54) SIGNAL PROCESSING APPARATUS, METHOD, AND PROGRAM

(71) Applicant: NIPPON TELEGRAPH AND TELEPHONE CORPORATION, Chiyoda-ku (JP)

(72) Inventors: Kenta Niwa, Musashino (JP); Kazunori Kobayashi, Musashino (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 0 days.

(21) Appl. No.: 15/120,678

(22) PCT Filed: Feb. 25, 2015

(86) PCT No.: PCT/JP2015/055442
§ 371 (c)(1),
(2) Date: Aug. 22, 2016

(87) PCT Pub. No.: WO2015/129760
PCT Pub. Date: Sep. 3, 2015

(65) Prior Publication Data

US 2016/0372131 A1 Dec. 22, 2016

(30) Foreign Application Priority Data

Feb. 28, 2014 (JP) ..... 2014-037820

(51) Int. Cl.
*G10L 21/028* (2013.01)
*G10L 21/0232* (2013.01)
(Continued)

(52) U.S. Cl.
CPC ..... *G10L 21/0232* (2013.01); *G10L 21/0264* (2013.01); *G10L 21/0324* (2013.01);
(Continued)

(58) Field of Classification Search
CPC ..... G10L 21/0232; G10L 21/0324; G10L 2021/02166; H04R 1/1083; H04R 2225/43; H04R 2410/01; H04R 2460/01
(Continued)

(56) References Cited

U.S. PATENT DOCUMENTS 8,660,281 B2 * 2/2014 Bouchard ..... G10L 21/0208 381/23.1
2011/0307249 A1 * 12/2011 Kellermann ..... G10L 21/0208 704/226

OTHER PUBLICATIONS

K. Niwa et al., "Implementation of Microphone Array for Improving Speech Recognition Rate in Noisy Environment", 3-2-5, Report of the 2014 Spring Meeting, Collection of Lectures and Essays At the Acoustical Society of Japan, (Mar. 12, 2014), pp. 717-718, with English translation (Total 8 pages).
(Continued)

*Primary Examiner* — Melur Ramakrishnaiah
(74) *Attorney, Agent, or Firm* — Oblon, McClelland, Maier & Neustadt, L.L.P.

(57) ABSTRACT

A signal processing technique the noise suppressing performance of which is more improved than conventional one is provided. A first component extraction unit 14 extracts a non-stationary component $\hat{\phi}_S^{(A)}(\omega, \tau)$ derived from a sound coming from a target area and a stationary component $\hat{\phi}_S^{(B)}(\omega, \tau)$ derived from an incoherent noise from a power spectrum density $\hat{\phi}_S(\omega, \tau)$ of the target area through processing of time average. A second component extraction unit 15 extracts a non-stationary component $\hat{\phi}_N^{(A)}(\omega, \tau)$ derived from an interference noise and a stationary component $\hat{\phi}_N^{(B)}(\omega, \tau)$ derived from an incoherent noise from a power spectrum density $\hat{\phi}_N(\omega, \tau)$ of a noise area.

6 Claims, 8 Drawing Sheets

(51) Int. Cl.

| | |
|---|---|
| ***G10L 21/0264*** | (2013.01) |
| ***H04R 3/00*** | (2006.01) |
| ***H04R 1/40*** | (2006.01) |
| ***G10L 21/0324*** | (2013.01) |
| *G10L 21/0216* | (2013.01) |

(52) U.S. Cl.
CPC ..... *H04R 1/406* (2013.01); *H04R 3/00* (2013.01); *G10L 2021/02166* (2013.01)

(58) Field of Classification Search
USPC ..... 381/194, 312, 23.1, 83, 93, 95–96, 381/316–318, 320, 71.1, 71.6, 71.12
See application file for complete search history.

(56) References Cited

OTHER PUBLICATIONS

C. Marro et al., "Analysis of Noise Reduction and Dereverberation Techniques Based on Microphone Arrays with Postfiltering", IEEE Transactions on Speech and Audio Processing, vol. 6, No. 3, (May 1998), pp. 240-259.

Y. Hioka et al., "Underdetermined Sound Source Separation Using Power Spectrum Density Estimated by Combination of Directivity Gain", IEEE Transactions on Audio, Speech, and Language Processing, vol. 21, No. 6, (Jun. 2013), pp. 1240-1250.

* cited by examiner

SIGNAL PROCESSING APPARATUS, METHOD, AND PROGRAM

TECHNICAL FIELD

The present invention relates to a technique that uses several microphones to perform clear sound collection of a sound source signal coming from a target direction.

BACKGROUND ART

Firstly, a framework of basic signal processing will be described.

It is assumed that an array formed of M microphones is used. M is an integer equal to or larger than 2. For example, it is assumed that M is on the order of 2 to 4. M may be on the order of 100. In an observation signal $X_m(\omega, \tau)$ (m=1, 2, . . . , M) at a frequency ω and a frame time τ, one target sound $S_0(\omega, \tau)$ and K interference noises $S_k(\omega, \tau)$ (k=1, 2, . . . , K) that are coherent and non-stationary and an incoherent stationary noise $N_m(\omega, \tau)$ are included. K is to be a predetermined positive integer. m is the number for each microphone, and the observation signal $X_m(\omega, \tau)$ is a signal obtained by converting a time domain signal collected using the microphone m into a frequency domain.

A target sound is a sound coming from a predetermined target area. A target area is an area in which a sound source desired to be collected is included. The number of the sound sources desired to be collected and the position of the sound source desired to be collected in the target area may be unknown. For example, it is assumed that an area in which six speakers and three microphones are arranged is divided into three areas (an area 1, an area 2, and an area 3), as illustrated in FIG. 6. When the sound source desired to be collected is included in the area 1, the area 1 is to be the target area.

The target sound may contain a reflected sound from a sound source outside the target area. For example, when the target area is the area 1, among sounds generated from sound sources included in the area 2 and the area 3, a sound coming to a microphone in the direction of the area 1 due to reflection may be contained in the target sound.

The target area may be an area within a predetermined distance from the microphone. In other words, the target area may be an area including a finite area. Furthermore, a plurality of target areas may be present. FIG. 7 is a diagram illustrating an example in which two target areas are present.

An area including a sound source generating a noise is also referred to as a noise area. In the example in FIG. 6, when a sound source generating a noise is included in each of the area 2 and the area 3, each of the area 2 and the area 3 is to be a noise area. Although each of the area 2 and the area 3 is a noise area in this example, an area including the area 2 and the area 3 may be a noise area. A noise area including a sound source generating an interference noise is particularly referred to as an interference noise area. The noise area is set so as to be different from the target area.

When a transfer characteristic from the m-th microphone to a target sound $S_0(\omega, \tau)$ is described as $A_{m0}(\omega)$ and a transfer characteristic from the m-th microphone to a k-th interference noise is described as $A_{mk}(\omega)$, the observation signal $X_m(\omega, \tau)$ is modeled as below.

$$X_m(\omega, \tau) = A_{m,0}(\omega)S_0(\omega, \tau) + \sum_{k=1}^{K} A_{m,k}(\omega)S_k(\omega, \tau) + N_m(\omega, \tau) \tag{1}$$

When the number of microphones is small, that is, M<K, for example, a framework in which a minimum variance distortionless response (MVDR) beamforming approach and a post-filter are combined is thought to be effective for suppressing noises (see Non-patent Literature 1, for example). FIG. 1 illustrates a processing flow of a post-filter type array. A filter coefficient $w_0(\omega)=[W_{0,1}(\omega), \ldots, W_{0,M}(\omega)]^T$ that is designed for emphasis of a target sound is calculated as below.

$$w_0(\omega) = \frac{R^{-1}(\omega)h_0(\omega)}{h_0^H(\omega)R^{-1}(\omega)h_0(\omega)} \tag{2}$$

With x being an optional vector or matrix, xT represents a transpose of x and xH represents a complex conjugate transpose of x. $h_0(\omega)=[H_{0,1}(\omega), \ldots, H_{0,M}(\omega)]^T$ is an array manifold vector in the target sound direction. The array manifold vector is a transfer characteristic $H_{0,m}(\omega)$ from the sound source to the microphone, the transfer characteristic $H_{0,m}(\omega)$ represented by a vector $h_0(\omega)$. The transfer characteristic $H_{0,m}(\omega)$ from the sound source to the microphone includes a transfer characteristic with which only a direct sound that can be theoretically calculated from the sound source and the microphone position is assumed, a transfer characteristic actually measured, and a transfer characteristic estimated by calculator simulation such as a mirror method and a finite element method. When it is assumed that source signals are uncorrelated with each other, a spatial correlation matrix R(ω) can be modeled as below.

$$R(\omega) = \sum_{k=1}^{K} h_k(\omega)h_k^H(\omega) \tag{3}$$

$h_k(\omega)$ here is an array manifold vector of the k-th interference noise. An output signal $Y_0(\omega, \tau)$ of beamforming is obtained with the formula below.

$$Y_0(\omega,\tau)=w_0^H(\omega)x(\omega,\tau) \tag{4}$$

$x(\omega, \tau)=[X_1(\omega, \tau), \ldots, X_M(\omega, \tau)]^T$ holds. To suppress a noise signal included in $Y_0(\omega, \tau)$, a post-filter $G(\omega, \tau)$ is multiplied.

$$Z(\omega,\tau)=G(\omega,\tau)Y_0(\omega,\tau) \tag{5}$$

Finally, $Z(\omega, \tau)$ is subjected to inverse fast Fourier transforming (IFFT), whereby the output signal is obtained.

Next, a post-filter designing method based on Non-patent Literature 2 will be described.

Non-patent Literature 2 proposes a method of designing a post-filter based on a power spectrum density (PSD) of each area estimated using multiple beamforming (see Non-patent Literature 2, for example). Hereinafter, this method is referred to as an LPSD method (local PSD-based post-filter design). FIG. 2 is used to describe the processing flow of the LPSD method.

When the post-filter is designed based on a Wiener method, $G(\omega, \tau)$ is calculated as below.

$$G(\omega, \tau) = \frac{\phi_S(\omega, \tau)}{\phi_S(\omega, \tau) + \phi_N(\omega, \tau)} \tag{6}$$

$\phi_S(\omega, \tau)$ represents the power spectrum density of the target area and $\phi_N(\omega, \tau)$ represents the power spectrum density of the noise area. The power spectrum density of a certain area means the power spectrum density of a sound coming from that area. More specifically, the power spectrum density of a target area is the power spectrum density of a sound coming from the target area, for example, and the power spectrum density of a noise area is the power spectrum density of a sound coming from the noise area. Although there are various methods of estimating $\phi_S(\omega, \tau)$ and $\phi_N(\omega, \tau)$ from $X_m(\omega, \tau)$, the LPSD method is used because it is assumed that the observation signal contains an interference noise.

With the LPSD method, it is assumed that the observation signal contains a target sound and an interference noise, which are sparse in the time-frequency domain. To analyze the power spectrum density of each area positioned in various directions, L+1 beamforming filters $w_u(\omega)$ (u=0, 1, . . . , L) are designed. The relation among a sensitivity $|D_{uk}(\omega)|^2$ in the direction of the k-th area of a filter $w_u(\omega)$, the power $|Y_u(\omega, \tau)|^2$ of the u-th output signal, and the power spectrum density $|S_k(\omega, \tau)|^2$ of each area can be modeled as below. For $|D_{uk}(\omega)|^2$, $|D_{uk}(\omega)|^2=|w_u^H(\omega)h_k(\omega)|^2$ holds, for example. As $|D_{uk}(\omega)|^2$, a measured value may be used.

$$\underbrace{\begin{bmatrix} |Y_0|^2 \\ |Y_1|^2 \\ \vdots \\ |Y_L|^2 \end{bmatrix}}_{\Phi_Y(\omega,\tau)} = \underbrace{\begin{bmatrix} |D_{0,0}|^2 & |D_{0,1}|^2 & \cdots & |D_{0,K}|^2 \\ |D_{1,0}|^2 & |D_{1,1}|^2 & \cdots & |D_{1,K}|^2 \\ \vdots & \vdots & \ddots & \vdots \\ |D_{L,0}|^2 & |D_{L,1}|^2 & \cdots & |D_{L,K}|^2 \end{bmatrix}}_{D(\omega)} \underbrace{\begin{bmatrix} |S_0|^2 \\ |S_1|^2 \\ \vdots \\ |S_K|^2 \end{bmatrix}}_{\Phi_S(\omega,\tau)} \tag{7}$$

The index of each symbol is here omitted. More specifically, $Y_u=Y_u(\omega, \tau)$, $D_{uk}=D_{uk}(\omega)$, and $S_u=S_u(\omega, \tau)$ hold. Furthermore, $\phi_Y(\omega, \tau)=[|Y_0(\omega, \tau)|^2, |Y_1(\omega, \tau)|^2, \ldots, |Y_L(\omega, \tau)|^2]T$ and $\phi_S(\omega, \tau)=[|S_0(\omega, \tau)|^2, |S_1(\omega, \tau)|^2, \ldots, |S_K(\omega, \tau)|^2]^T$ hold.

For example, the power spectrum density of each area is calculated by solving the inverse problem of formula (7).

$$\hat{\Phi}_S(\omega,\tau)=D^+(\omega)\Phi_Y(\omega,\tau) \tag{8}$$

With b being an optional matrix, b+ represents a pseudo inverse matrix calculation for b. A local PSD estimation unit 11 uses the observation signal $X_m(\omega, \tau)$ (m=1, 2, . . . , M) as an input to output a local power spectrum density $\hat{\phi}_S(\omega, \tau)$ defined by formula (8), for example. "^" indicates that the density is from estimation.

Local indicates an area. In the example in FIG. 6, each of the area 1, the area 2, and the area 3 is local. The local PSD estimation unit estimates the power spectrum density $\hat{\phi}_S(\omega, \tau)$ of each area and outputs the estimated power spectrum density $\hat{\phi}_S(\omega, \tau)$.

A target area/noise area PSD estimation unit 12 uses the local power spectrum density $\hat{\phi}_S(\omega, \tau)$ estimated based on formula (8) for each frequency ω and frame τ as an input to calculate $\hat{\phi}_S(\omega, \tau)$ and $\hat{\phi}_N(\omega, \tau)$ which are defined by the formula below.

$$\hat{\phi}_S(\omega, \tau) = |\hat{S}_0(\omega, \tau)|^2 \tag{9}$$

$$\hat{\phi}_N(\omega, \tau) = \sum_{k=1}^{K} |\hat{S}_k(\omega, \tau)|^2 \tag{10}$$

Finally, a Wiener gain calculation unit 13 uses $\hat{\phi}_S(\omega, \tau)$ and $\hat{\phi}_N(\omega, \tau)$ as an input to calculate the post-filter $\tilde{G}(\omega, \tau)$ defined by formula (6) and outputs the calculated post-filter $G(\omega, \tau)$. Specifically, the Wiener gain calculation unit 13 inputs $\hat{\phi}_S(\omega, \tau)$ and $\hat{\phi}_N(\omega, \tau)$ as $\phi_S(\omega, \tau)$ and $\phi_N(\omega, \tau)$ of formula (6) to calculate $G(\omega, \tau)$ and outputs the calculated $G(\omega, \tau)$.

Two main advantages of the LPSD method are described below. (i) In a power spectrum domain, the relation between an output of beamforming and each sound source is formulated, whereby flexibility of control surpassing the number of microphones can be achieved and noises thus can be effectively suppressed. (ii) By calculating in advance L beamforming filters $w_u(\omega)$ (u=0, 1, . . . , L) and $D(\omega)$ of formula (7), the merit of (i) can be implemented with low-complexity.

PRIOR ART LITERATURE

Non-Patent Literature

Non-patent Literature 1: C. Marro et al., "Analysis of noise reduction and dereverberation techniques based on microphone arrays with postfiltering," IEEE Trans. Speech, Audio Proc., 6, 240-259, 1998.

Non-patent Literature 2: Y. Hioka et al., "Underdetermined sound source separation using power spectrum density estimated by combination of directivity gain," IEEE Trans. Audio, Speech, Language Proc., 21, 1240-1250, 2013.

SUMMARY OF THE INVENTION

Problems to be Solved by the Invention

With an LPSD method, a problem has been formulated assuming that a target sound and an interference noise are mixed. However, in an actual problem, not only a coherent interference noise but also a stationary noise being highly incoherent (such as air-conditioning noise and microphone's internal noise) is often mixed. In such a case, estimation errors of $\phi_S(\omega, \tau)$ and $\phi_N(\omega, \tau)$ become large and the noise suppressing performance is lowered in some cases.

An object of the present invention is to provide a signal processing apparatus, a method, and a program whose noise suppressing performances are more improved than conventional ones.

Means to Solve the Problems

A signal processing apparatus according to an aspect of the present invention includes a local PSD estimation unit, a target area/noise area PSD estimation unit, a first component extraction unit, a second component extraction unit, and a various noise responding gain calculation unit. The local PSD estimation unit estimates each of a local power spectrum density of a target area and that of at least one noise area different from the target area based on an observation signal of a frequency domain obtained from a signal collected with M microphones forming a microphone array. The target area/noise area PSD estimation unit estimates a power spectrum density $\hat{\phi}_S(\omega, \tau)$ of the target area and a power spectrum density $\hat{\phi}_N(\omega, \tau)$ of the noise area based on the estimated local power spectrum density, w being a frequency and r being an index of a frame. The first component extraction unit extracts a non-stationary component $\hat{\phi}_S^{(A)}(\omega, \tau)$ derived from a sound coming from the target area and a stationary component $\hat{\phi}_S^{(B)}(\omega, \tau)$ derived from an incoherent noise from the power spectrum density $\hat{\phi}_S(\omega, \tau)$ of the target area. The second component extraction unit extracts a non-stationary component $\hat{\phi}_N^{(A)}(\omega, \tau)$ derived from an interference noise from a power spectrum density $\hat{\phi}_N(\omega, \tau)$ of the noise area. The various noise responding gain calculation unit uses at least the non-stationary component $\hat{\phi}_S^{(A)}(\omega, \tau)$ derived from a sound coming from the target area, the stationary component $\hat{\phi}_S^{(B)}(\omega, \tau)$ derived from an incoherent noise, and the non-stationary component $\hat{\phi}_N^{(A)}(\omega, \tau)$ derived from an interference noise to calculate a post-filter $G(\omega, \tau)$ emphasizing the non-stationary component of the sound coming from the target area.

Effects of the Invention

The present invention can improve the noise suppressing performance compared with a conventional case.

DETAILED DESCRIPTION OF THE EMBODIMENT

With a signal processing apparatus and a method described below, an LPSD method is expanded to robustly estimate a post-filter with respect to various noise environments. Specifically, a power spectrum density is estimated in a divided manner for each noise type, whereby an estimation error of the ratio of the power of a target sound to that of other noise is reduced.

Figure 1:
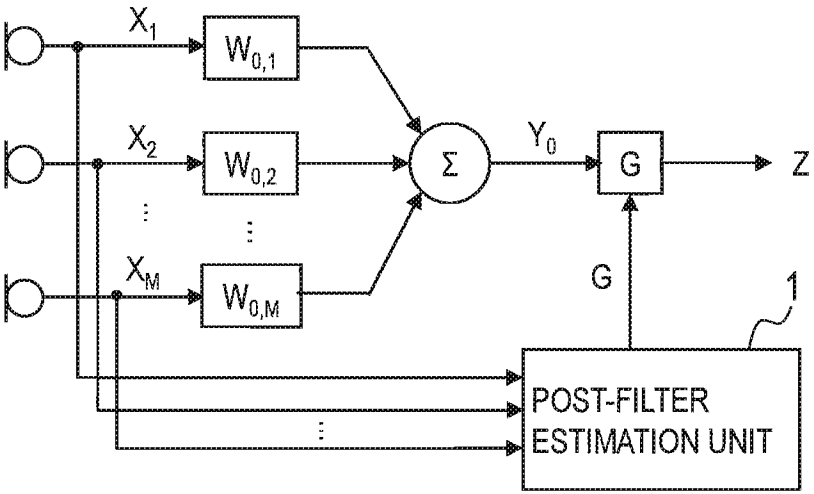
FIG. 1 is a diagram illustrating a processing flow of a post-filter type array.
Figure 2:
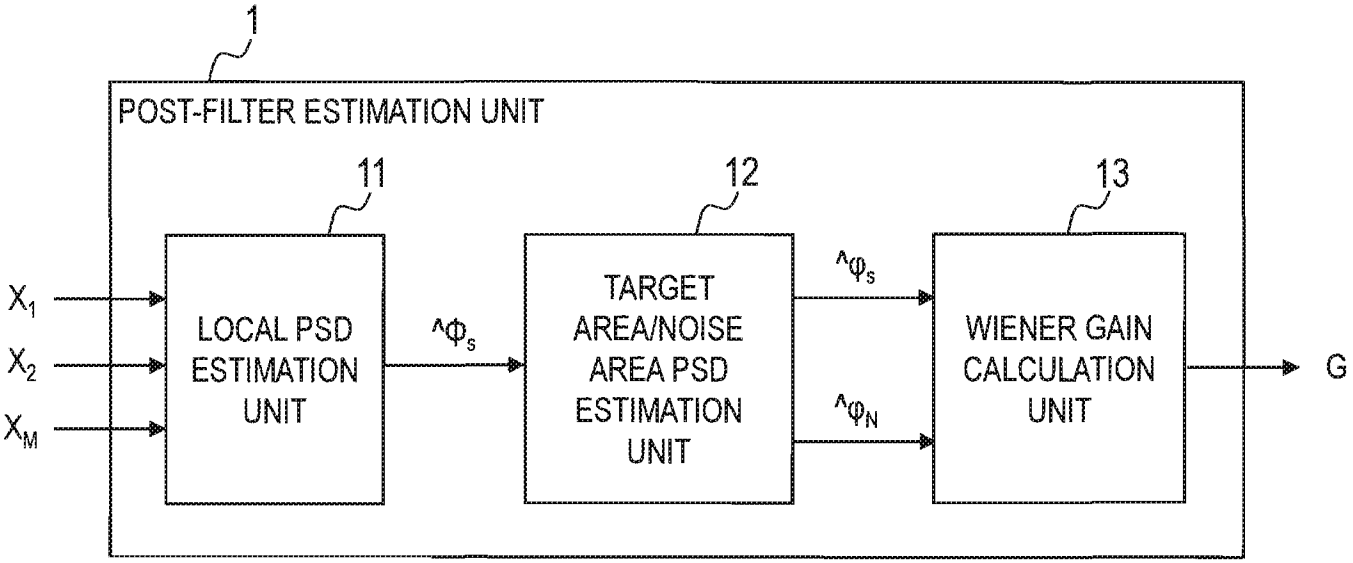
FIG. 2 is a block diagram of a conventional post-filter estimation unit.
Figure 3:
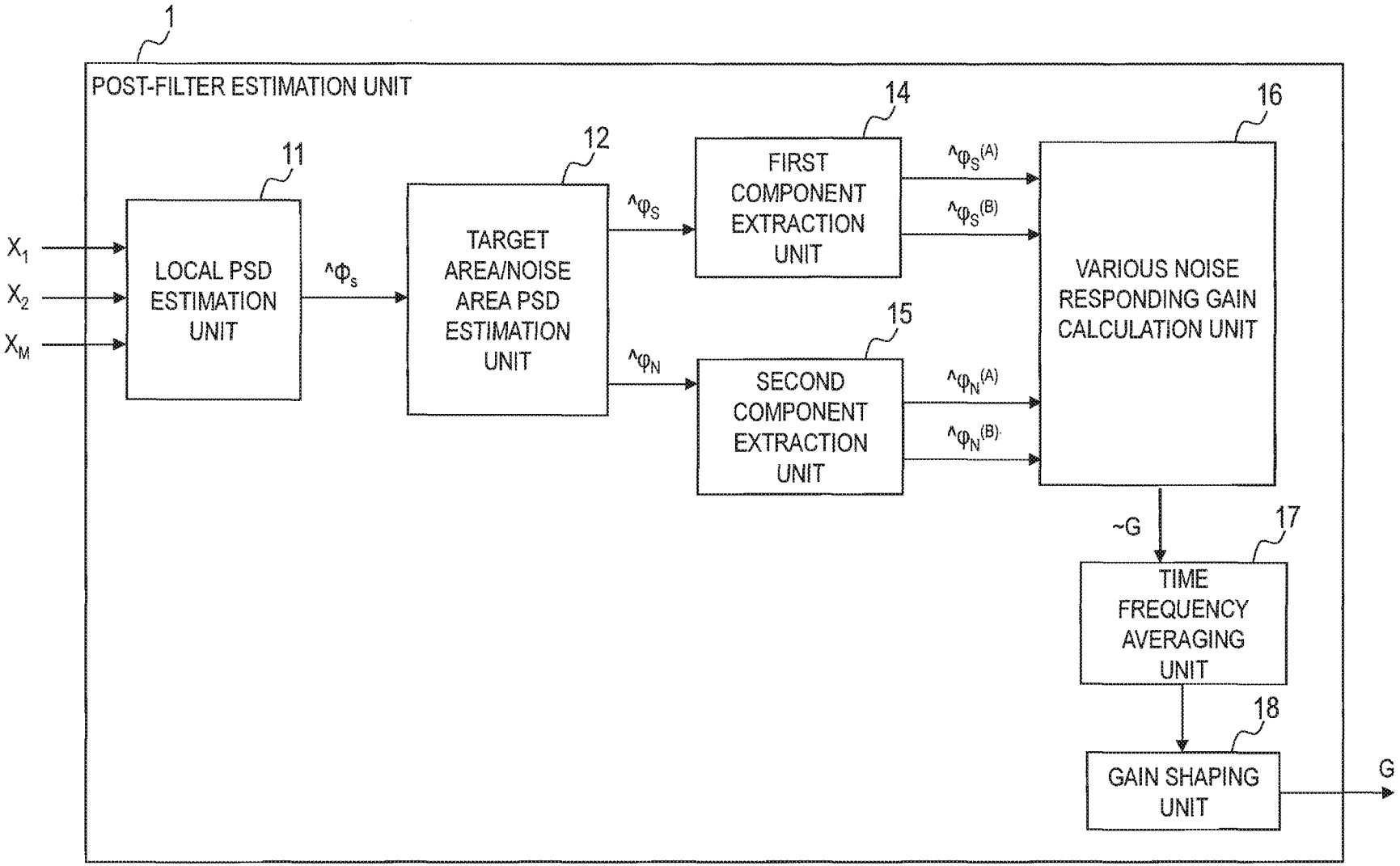
FIG. 3 is a block diagram of an exemplary post-filter estimation apparatus according to the present invention.

FIG. 3 is a block diagram of an exemplary post-filter estimation unit 1 serving as a signal processing apparatus according to an embodiment of the present invention.

The signal processing apparatus includes, as illustrated in FIG. 3, a local PSD estimation unit 11, a target area/noise area PSD estimation unit 12, a first component extraction unit 14, a second component extraction unit 15, a various noise responding gain calculation unit 16, a time frequency averaging unit 17, and a gain shaping unit 18, for example.

Figure 4:
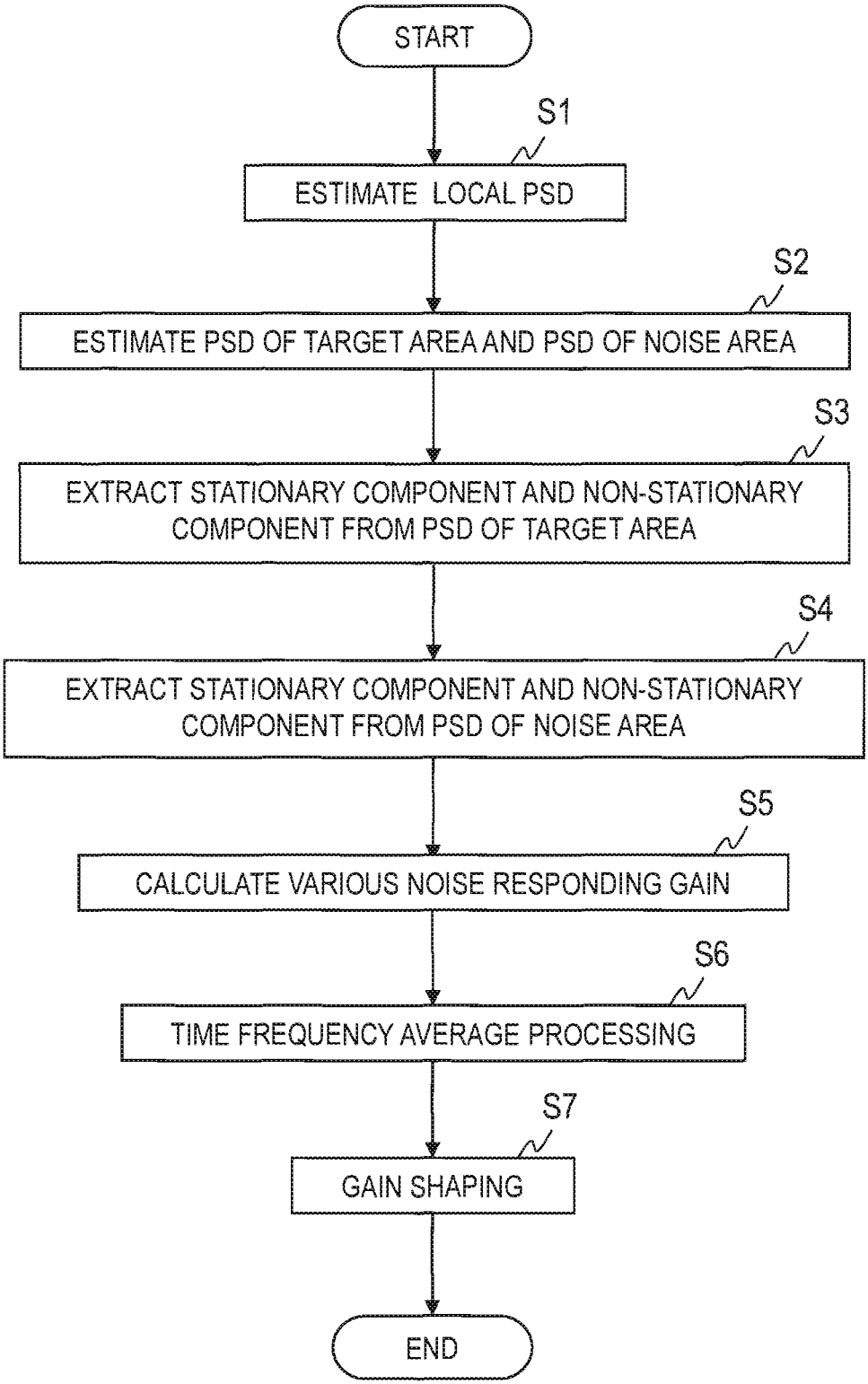
FIG. 4 is a block diagram of an exemplary post-filter estimation method according to the present invention.

Each step of signal processing implemented by this signal processing apparatus, for example, is illustrated in FIG. 4.

Details of an embodiment of the signal processing apparatus and the method will be described below. It should be noted that the basic signal processing framework, definition of terms, and the like are similar to those described in [BACKGROUND ART]. A repeated explanation thereof thus will be omitted.

<Local PSD Estimation Unit 11>

The local PSD estimation unit 11 is similar to a conventional local PSD estimation unit 11.

More specifically, the local PSD estimation unit 11 estimates a local power spectrum density $\hat{\phi}_S(\omega, \tau)$ of each of a target area and a noise area based on an observation signal $X_m(\omega, \tau)$ (m=1, 2, . . . , M) of a frequency domain obtained from a signal collected with M microphones forming a microphone array (Step S1). $\omega$ is a frequency and $\tau$ is an index of a frame. M is an integer equal to or larger than 2. For example, M is on the order of 2 to 4. M may be on the order of 100.

The estimated local power spectrum density $\hat{\phi}_S(\omega, \tau)$ is output to the target area/noise area PSD estimation unit 12.

Examples of specific processing of estimating the local power spectrum density are similar to those described in [BACKGROUND ART]. The explanation thereof thus will be omitted here.

It should be noted that a beamforming filters $w_u(\omega)$ and a sensitivity $|D_{uk}(\omega)|^2$ are to be set in advance, prior to the processing performed by the local PSD estimation unit 11. Furthermore, when the direction of the target area is changed to some degrees, the local PSD estimation unit 11 may prepare a plurality of filter sets and select the filter with which the power is the maximum.

It should be noted that the local PSD estimation unit 11 may estimate the local power spectrum density $\hat{\phi}_S(\omega, \tau)$ based not on $Y_u(\omega, \tau)$ (u=0, 1, . . . , L) obtained by beamforming, but on $Y_u(\omega, \tau)$ (u=0, 1, . . . , L) collected with microphones, each one of which has directionality in the direction of each area.

<Target Area/Noise Area PSD Estimation Unit 12>

The target area/noise area PSD estimation unit 12 is similar to a conventional target area/noise area PSD estimation unit 12.

More specifically, the target area/noise area PSD estimation unit 12 estimates the power spectrum density $\hat{\phi}_S(\omega, \tau)$ of the target area and the power spectrum density $\hat{\phi}_N(\omega, \tau)$ of the noise area based on the estimated local power spectrum density (Step S2).

The estimated power spectrum density $\hat{\phi}_S(\omega, \tau)$ of the target area is output to the first component extraction unit 14. The estimated power spectrum density $\hat{\phi}_N(\omega, \tau)$ of the noise area is output to the second component extraction unit 15.

Examples of specific processing of estimating the power spectrum density $\hat{\phi}_S(\omega, \tau)$ of the target area and the power spectrum density $\hat{\phi}_N(\omega, \tau)$ of the noise area are similar to those described in [BACKGROUND ART]. The explanation thereof thus will be omitted here.

<First Component Extraction Unit 14>

For example, in $\hat{\phi}_S(\omega, \tau)$ defined by formula (9), a non-stationary component $\hat{\phi}_S^{(A)}(\omega, \tau)$ derived from a sound coming from the target area and a stationary component $\hat{\phi}_S^{(B)}(\omega, \tau)$ derived from an incoherent noise are included. In this case, the stationary component is a component the temporal change of which is small and the non-stationary component is a component the temporal change of which is large.

In this case, the noise includes two types of noises, an interference noise and an incoherent noise. The interference noise is a noise emitted from a noise sound source arranged in the noise area. The incoherent noise is not a noise emitted from the target area or the noise area, but a noise emitted from a place other than these areas and being regularly present.

The first component extraction unit 14 extracts the non-stationary component $\hat{\phi}_S^{(A)}(\omega, \tau)$ derived from a sound coming from the target area and the stationary component $\hat{\phi}_S^{(B)}(\omega, \tau)$ derived from an incoherent noise from the power spectrum density $\hat{\phi}_S(\omega, \tau)$ of the target area through smoothing processing (Step S3). For example, the smoothing processing is implemented by processing of exponential moving average, time average, and weighted average as in formulas (11) and (12).

The extracted non-stationary component $\hat{\phi}_S^{(A)}(\omega, \tau)$ derived from a sound coming from the target area and stationary component $\hat{\phi}_S^{(B)}(\omega, \tau)$ derived from an incoherent noise are output to the various noise responding gain calculation unit 16.

For example, the first component extraction unit 14 performs processing of exponential moving average as in formulas (11) and (12), thereby calculating $\hat{\phi}_S^{(B)}(\omega, \tau)$ from $\hat{\phi}_S(\omega, \tau)$.

$$\tilde{\phi}_s(\omega, \tau) = \alpha_S \hat{\phi}_s(\omega, \tau) + (1 + \alpha_S)\tilde{\phi}_s(\omega, \tau - 1) \tag{11}$$

$$\hat{\phi}_s^{(B)}(\omega, \tau) = \min_{\tau \in Y_s} \{\tilde{\phi}_s(\omega, \tau)\} \tag{12}$$

$\alpha_S$ here is a smoothing coefficient and a predetermined positive actual number. For example, $0<\alpha_S<1$ holds. Furthermore, with $\alpha_S$=time length/time constant of a frame, as may be set such that the time constant is on the order of 150 ms. $Y_S$ is a set of indexes of frames for a predetermined interval. For example, $Y_S$ is set such that the predetermined interval is on the order of 3 to 4 seconds. min is a function that outputs the minimum value.

$\hat{\phi}_S^{(B)}(\omega, \tau)$ thus is a component obtained by smoothing $\hat{\phi}_S(\omega, \tau)$ by formulas (11) and (12), for example. More specifically, $\hat{\phi}_S^{(B)}(\omega, \tau)$ is the minimum value in a predetermined time interval of a value obtained by smoothing $\hat{\phi}_S(\omega, \tau)$ by formula (11), for example.

The first component extraction unit 14 subtracts $\hat{\phi}_S^{(B)}(\omega, \tau)$ from $\hat{\phi}_S(\omega, \tau)$, thereby calculating $\hat{\phi}_S^{(A)}(\omega, \tau)$, as in formula (13).

$$\hat{\phi}_S^{(A)}(\omega,\tau)=\hat{\phi}_S(\omega,\tau)-\beta_S(\omega)\hat{\phi}_S^{(B)}(\omega,\tau) \tag{13}$$

$\beta_S(\omega)$ here is a weighted coefficient and a predetermined positive actual number. $\beta_S(\omega)$ is set to an actual number on the order of 1 to 3, for example.

$\phi_S^{(A)}(\omega, \tau)$ thus is a component obtained by removing $\hat{\phi}_S^{(B)}(\omega, \tau)$ from $\hat{\phi}_S(\omega, \tau)$.

It should be noted that $\hat{\phi}_S^{(A)}(\omega, \tau)$ may be subjected to flooring processing such that a condition of $\hat{\phi}_S^{(A)}(\omega, \tau)\geq 0$ is satisfied. This flooring processing is performed by the first component extraction unit 14, for example.

<Second Component Extraction Unit 15>

For example, in $\hat{\phi}_N(\omega, \tau)$ defined by formula (10), a non-stationary component $\hat{\phi}_N^{(A)}(\omega, \tau)$ derived from an interference noise and a stationary component $\hat{\phi}_N^{(B)}(\omega, \tau)$ derived from an incoherent noise are included.

The second component extraction unit 15 extracts the non-stationary component $\hat{\phi}_N^{(A)}(\omega, \tau)$ derived from an interference noise and the stationary component $\hat{\phi}_N^{(B)}(\omega, \tau)$ derived from an incoherent noise from the power spectrum density $\hat{\phi}_N(\omega, \tau)$ of the noise area through smoothing processing (Step S4). For example, the smoothing processing is implemented by processing of exponential moving average, time average, and weighted average as in formulas (14) and (15).

The extracted non-stationary component $\hat{\phi}_N^{(A)}(\omega, \tau)$ derived from an interference noise and stationary component $\hat{\phi}_N^{(B)}(\omega, \tau)$ derived from an incoherent noise are output to the various noise responding gain calculation unit 16.

For example, the second component extraction unit 15 performs processing of exponential moving average as in formulas (14) and (15), thereby calculating $\hat{\phi}_N^{(B)}(\omega, \tau)$ from $\hat{\phi}_N(\omega, \tau)$.

$$\tilde{\phi}_N(\omega, \tau) = \alpha_N \hat{\phi}_N(\omega, \tau) + (1 - \alpha_N)\tilde{\phi}_N(\omega, \tau - 1) \tag{14}$$

$$\hat{\phi}_N^{(B)}(\omega, \tau) = \min_{\tau \in Y_N} \{\tilde{\phi}_N(\omega, \tau)\} \tag{15}$$

$\alpha_N$ here is a smoothing coefficient and a predetermined positive actual number. For example, $0<\alpha_N<1$ holds. Furthermore, with $\alpha_N$=time length/time constant of a frame, $\alpha_N$ may be set such that the time constant is on the order of 150 ms. $Y_N$ is a set of indexes of frames for a predetermined interval. For example, $Y_N$ is set such that the predetermined interval is on the order of 3 to 4 seconds.

$\phi_N^{(B)}(\omega, \tau)$ thus is a component obtained by smoothing $\hat{\phi}_N(\omega, \tau)$ by formulas (14) and (15), for example. More specifically, $\hat{\phi}_N^{(B)}(\omega, \tau)$ is the minimum value in a predetermined time interval of a value obtained by smoothing $\hat{\phi}_N(\omega, \tau)$ by formula (14), for example.

The second component extraction unit 15 subtracts $\hat{\phi}_N^{(B)}(\omega, \tau)$ from $\hat{\phi}_N(\omega, \tau)$, thereby calculating $\hat{\phi}_N^{(A)}(\omega, \tau)$, as in formula (16).

$$\hat{\phi}_N^{(A)}(\omega,\tau)=\hat{\phi}_N(\omega,\tau)-\beta_N(\omega)\hat{\phi}_N^{(B)}(\omega,\tau) \tag{16}$$

$\beta_N(\omega)$ here is a weighted coefficient and a predetermined positive actual number. $\beta_N(\omega)$ is set to an actual number on the order of 1 to 3, for example.

$\phi_N^{(A)}(\omega, \tau)$ thus is a component obtained by removing $\hat{\phi}_N^{(B)}(\omega, \tau)$ from $\hat{\phi}_N(\omega, \tau)$.

It should be noted that $\hat{\phi}_N^{(A)}(\omega, \tau)$ may be subjected to flooring processing such that a condition of $\hat{\phi}_N^{(A)}(\omega, \tau)\geq 0$ is satisfied. This flooring processing is performed by the second component extraction unit 15, for example.

$\alpha_N$ may be the same as $\alpha_S$ and may be different from $\alpha_S$. $Y_N$ may be the same as $Y_S$ and may be different from $Y_S$. $\beta_N(\omega)$ may be the same as $\beta_S(\omega)$ and may be different from $\beta_S(\omega)$.

It should be noted that when $\hat{\phi}_N^{(B)}(\omega, \tau)$ is not used in the various noise responding gain calculation unit 16, the second component extraction unit 15 does not have to obtain $\hat{\phi}_N^{(B)}(\omega, \tau)$. In other words, the second component extraction unit 15 may obtain only $\hat{\phi}_N^{(A)}(\omega, \tau)$ from $\hat{\phi}_N(\omega, \tau)$ in this case.

<Various Noise Responding Gain Calculation Unit 16>

The various noise responding gain calculation unit 16 uses at least the non-stationary component $\hat{\phi}_S^{(A)}(\omega, \tau)$ derived from a sound coming from the target area, the stationary component $\hat{\phi}_S^{(B)}(\omega, \tau)$ derived from an incoherent noise, and the non-stationary component $\hat{\phi}_N^{(A)}(\omega, \tau)$ derived from an interference noise to calculate a post-filter $G(\omega, \tau)$ emphasizing the non-stationary component of the sound coming from the target area (Step S5).

The calculated post-filter $G(\omega, \tau)$ is output to the time frequency averaging unit 17.

Because power spectrum density estimation is performed for each noise type (in other words, for each of the noise types, incoherent noise and coherent noise), the various noise responding gain calculation unit 16 calculates the post-filter $G(\omega, \tau)$ defined by formula (17) below, for example.

$$\tilde{G}(\omega, \tau) = \frac{\hat{\phi}_S^{(A)}(\omega, \tau)}{\hat{\phi}_S^{(A)}(\omega, \tau) + \hat{\phi}_S^{(B)}(\omega, \tau) + \hat{\phi}_N^{(A)}(\omega, \tau)} \tag{17}$$

When there is a difference between the behavior of the value of $\hat{\phi}_S^{(B)}(\omega, \tau)$ and that of the value of $\hat{\phi}_N^{(B)}(\omega, \tau)$ and the assumption of the incoherence has been destroyed, the various noise responding gain calculation unit 16 may calculate the post-filter $G(\omega, \tau)$ defined by formula (18) below.

$$\tilde{G}(\omega, \tau) = \frac{\hat{\phi}_S^{(A)}(\omega, \tau)}{\hat{\phi}_S^{(A)}(\omega, \tau) + \hat{\phi}_S^{(B)}(\omega, \tau) + \hat{\phi}_N^{(A)}(\omega, \tau) + \hat{\phi}_N^{(B)}(\omega, \tau)}. \tag{18}$$

<Time Frequency Averaging Unit 17>

The time frequency averaging unit 17 performs smoothing processing in at least one of the time direction and the frequency direction with respect to the post-filter $G(\omega, \tau)$ (Step S6).

The post-filter $G(\omega, \tau)$ subjected to the smoothing processing is output to the gain shaping unit 18.

When the smoothing processing is performed in the time direction, with $\tau_0$ and $\tau_1$ being integers equal to or larger than 0, the time frequency averaging unit 17 may perform additional average with respect to $G(\omega, \tau-\tau_0), \ldots, G(\omega, \tau+\tau_1)$ being a post-filter in the vicinity of the post-filter $G(\omega, \tau)$ in the time direction, for example. The time frequency averaging unit 17 may perform weighted addition with respect to $G(\omega, \tau-\tau_0), \ldots, G(\omega, \tau+\tau_1)$.

Furthermore, when the smoothing processing is performed in the frequency direction, with $\omega_0$ and $\omega_1$ being actual numbers equal to or larger than 0, the time frequency averaging unit 17 may perform additional average with respect to $G(\omega-\omega_0, \tau), \ldots, G(\omega+\omega_1, \tau)$ being a post-filter in the vicinity of the post-filter $G(\omega, \tau)$ in the frequency direction, for example. The time frequency averaging unit 17 may perform weighted addition with respect to $G(\omega-\omega_0, \tau), \ldots, G(\omega+\omega_1, \tau)$.

<Gain Shaping Unit 18>

The gain shaping unit 18 performs gain shaping with respect to the post-filter $G(\omega, \tau)$ subjected to the smoothing processing, thereby generating the post-filter $G(\omega, \tau)$ (Step S7). The gain shaping unit 18 generates the post-filter $G(\omega, \tau)$ defined by formula (19) below, for example.

$$G(\omega,\tau)=\gamma(\tilde{G}(\omega,\tau)-0.5)+0.5 \tag{19}$$

$\gamma$ here is a weighted coefficient and a positive actual number. $\gamma$ may be set to an actual number on the order of 1 to 1.3, for example.

The gain shaping unit 18 may perform flooring processing with respect to the post-filter $G(\omega, \tau)$ such that $A \le G(\omega, \tau) \le 1$ is satisfied. A is an actual number from 0 to 0.3 and normally on the order of 0.1. When $G(\omega, \tau)$ is larger than 1, too much emphasis may be caused. When $G(\omega, \tau)$ is too small, a musical noise may be generated. With appropriate flooring processing performed, the emphasis and generation of a musical noise can be prevented.

A function f the domain and the range of which are actual numbers is considered. The function f is a non-decreasing function, for example. Gain shaping means an operation for obtaining an output value when $G(\omega, \tau)$ before gain shaping is input to the function f. In other words, an output value when $G(\omega, \tau)$ is input to the function f is $G(\omega, \tau)$. An example of the function f is formula (19). With the function f in accordance with formula (19), $f(x)=\gamma(x-0.5)+0.5$ holds.

Figure 8:
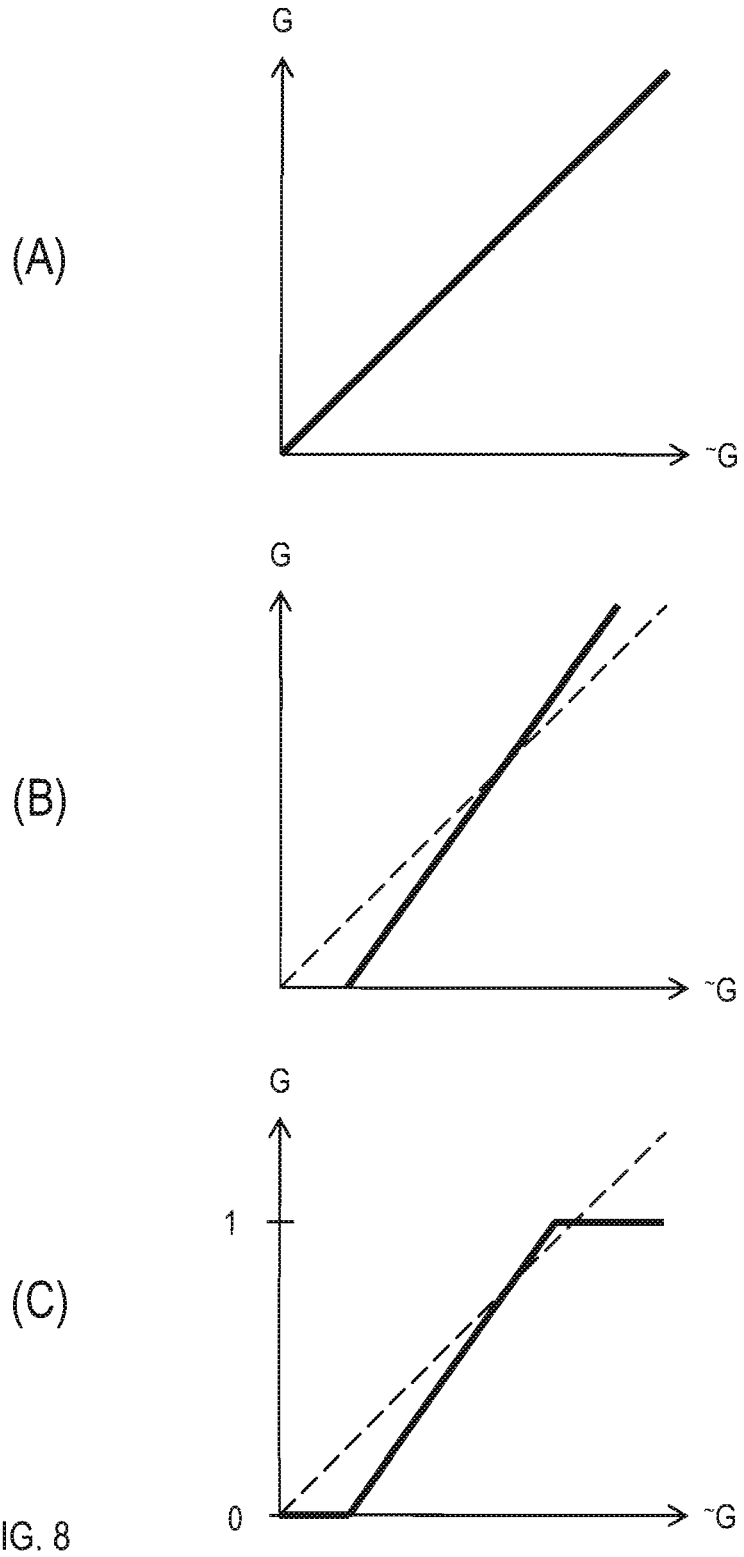
FIG. 8 is diagrams for explaining exemplary gain shaping.

Another example of other function f will be described with reference to FIG. 8. In FIG. 8, indexes are omitted. More specifically, G in FIG. 8 represents $G(\omega, \tau)$, and G represents $G(\omega, \tau)$. Firstly, in this example, as illustrated in FIG. 8(A) to FIG. 8(B), the tilt of the graph of the function f is varied. Furthermore, as illustrated in FIG. 8(B) to FIG. 8(C), flooring processing is performed such that $0 \le G(\omega, \tau) \le 1$ is satisfied. The function specified by the graph represented by the bold line in FIG. 8(C) is the other example of function f.

The graph of the function f is not limited to that illustrated in FIG. 8(C). For example, in FIG. 8(C), the graph of the function f is formed of a straight line. However, the graph of the function f may be formed of a curved line. For example, the function f may be subjected to flooring processing with respect to a hyperbolic tangent function.

According to the above-described signal processing apparatus and method, a post-filter for robustly suppressing noises can be designed with respect to an environment in which noises having various properties are present. Furthermore, such a post-filter can be designed with processing with real-time property.

Implementation Example and Experiment Result

Figure 5:
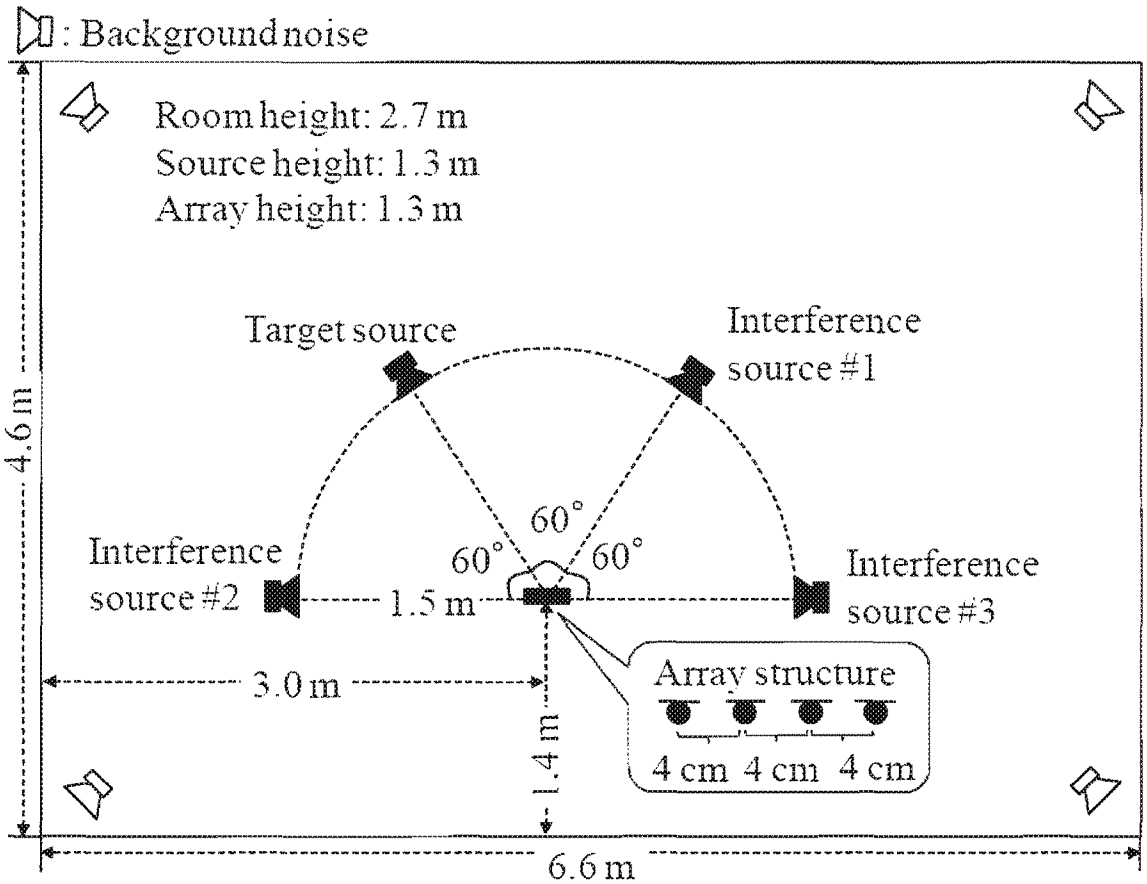
FIG. 5 is a diagram for explaining an experiment result.
Figure 6:
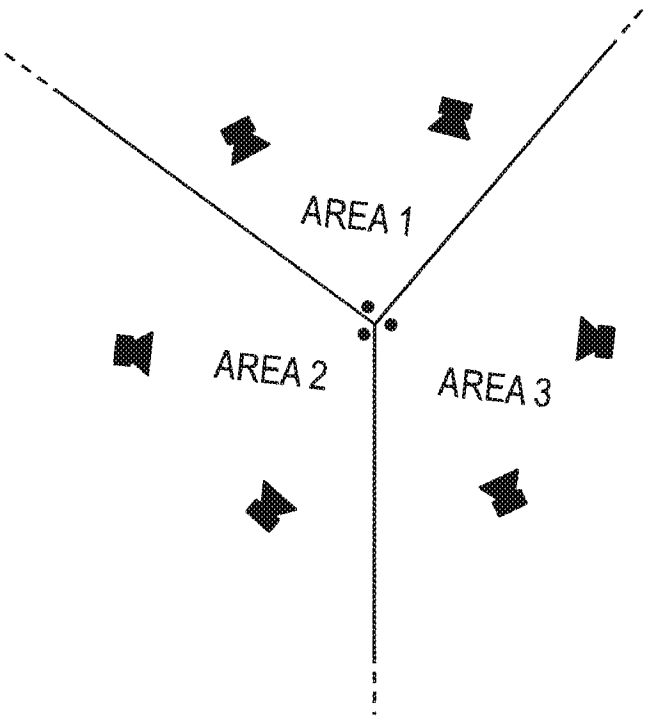
FIG. 6 is a diagram for explaining an exemplary target area and an exemplary noise area.
Figure 7:
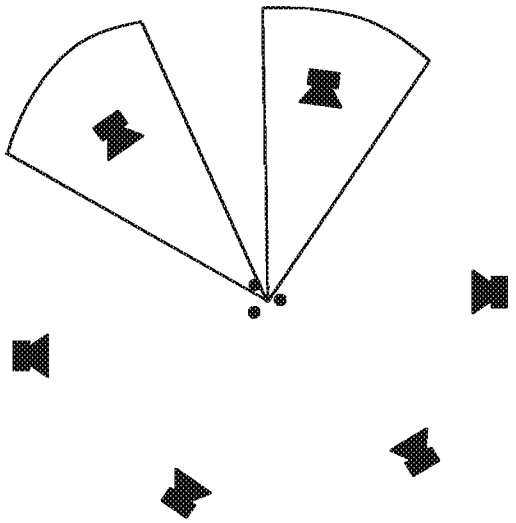
FIG. 7 is a diagram for explaining an exemplary target area.

With the LPSD method as a conventional method, an experiment for verifying the effect of the proposed method has been performed. As illustrated in FIG. 5, a sound source and an array are arranged in a room the reverberation time of which is 110 ms (1.0 kHz). With target sounds (speech of a man and a woman), K=3 interference noises (#1: speech of a man and a woman, #2, 3: music), and background noises reproduced with white noises radiated from speakers at the four corners of the room, M=4 non-directional microphones are used for recording. The SN ratio during the observation is −1 dB on average. Furthermore, the sampling frequency is 16.0 kHz, the FFT analysis length is 512 pt, and the FFT shift length is 256 pt.

Under these conditions, the noise suppressing performance has been evaluated through spectral distortion (SD) defined by the formula below $$SD = \frac{1}{|\Psi|}\sum_{\tau\in\Psi}\sqrt{\frac{1}{|\Omega|}\sum_{\omega\in\Psi}\left(10\log_{10}\frac{S_0(\omega, \tau)}{Z(\omega, \tau)}\right)^2} \tag{20}$$

$\Psi$ and $|\Psi|$ here represent a set of indexes of the frame and the total number thereof, respectively. $\Omega$ and $|\Omega|$ represent an index of a frequency bin and the total number thereof. The smaller the SD value, the higher the noise suppressing performance. The SD is calculated with respect to 650 sentences of speech of a man and a woman to be 14.0 with the conventional method and 11.5 with the proposed method. This indicates that the SD is reduced. Especially, the suppressing effect is increased with respect to the background noises outside the speech section.

Modification and Other

Processing performed by the time frequency averaging unit 17 and the gain shaping unit 18 is performed to suppress what is called musical noises. The processing performed by the time frequency averaging unit 17 and the gain shaping unit 18 does not have to be performed.

Calculation of $\hat{\phi}_S^{(B)}(\omega, \tau)$ and $\hat{\phi}_S^{(A)}(\omega, \tau)$ through processing of exponential moving average is an example of the processing performed by the first component extraction unit 14. The first component extraction unit 14 may extract $\hat{\phi}_S^{(B)}(\omega, \tau)$ and $\hat{\phi}_S^{(A)}(\omega, \tau)$ through other processing.

Similarly, the calculation of $\hat{\phi}_N^{(B)}(\omega, \tau)$ and $\hat{\phi}_N^{(A)}(\omega, \tau)$ through processing of exponential moving average is an example of the processing performed by the second component extraction unit 15. The second component extraction unit 15 may extract $\hat{\phi}_N^{(B)}(\omega, \tau)$ and $\hat{\phi}_N^{(A)}(\omega, \tau)$ through other processing.

The processing explained with respect to the signal processing apparatus and method described above may be performed not only in time series in accordance with the described order but also in parallel or individually in accordance with the processing capacity of the apparatus performing the processing or the need.

Furthermore, when each unit in the signal processing apparatus is implemented by a computer, the processing content of the function that has to be included in each unit in the signal processing apparatus is written in a program. With this program executed on the computer, the unit is implemented on the computer.

This program with the processing content written thereinto can be stored in a computer-readable recording medium. Examples of such a computer-readable recording medium include a magnetic recording device, an optical disk, a magneto-optical recording medium, and a semiconductor memory, and any type of computer-readable recording medium is acceptable.

Furthermore, it may be configured such that each processing means is implemented with a predetermined program executed on the computer, and at least part of the processing contents thereof may be implemented in a hardware manner.

Needless to say, modifications also can be added as appropriate within the scope of the present invention.

INDUSTRIAL APPLICABILITY

Voice recognition has come to be generally used as a command input to a smartphone. In a noisy environment such as in a vehicle or in a factory, it is conceivable that there is a high demand for operating the device in a hands-free manner or making a call to a remote area.

The present invention can be utilized in such a case, for example.

What is claimed is:

1. A signal processing apparatus comprising:

a local PSD estimation unit that estimates each of a local power spectrum density of a predetermined target area and that of at least one noise area different from the target area based on an observation signal of a frequency domain obtained from a signal collected with M microphones forming a microphone array;

a target area/noise area PSD estimation unit that estimates a power spectrum density $\hat{\phi}_S(\omega, \tau)$ of the target area and a power spectrum density $\hat{\phi}_N(\omega, \tau)$ of the noise area based on the estimated local power spectrum density, ω being a frequency and τ being an index of a frame;

a first component extraction unit that extracts a non-stationary component $\hat{\phi}_S^{(A)}(\omega, \tau)$ derived from a sound coming from the target area and a stationary component $\hat{\phi}_S^{(B)}(\omega, \tau)$ derived from an incoherent noise from the power spectrum density $\hat{\phi}_S(\omega, \tau)$ of the target area;

a second component extraction unit that extracts a non-stationary component $\hat{\phi}_N^{(A)}(\omega, \tau)$ derived from an interference noise from the power spectrum density $\hat{\phi}_N(\omega, \tau)$ of the noise area; and a various noise responding gain calculation unit that uses at least the non-stationary component $\hat{\phi}_S^{(A)}(\omega, \tau)$ derived from a sound coming from the target area, the stationary component $\hat{\phi}_S^{(B)}(\omega, \tau)$ derived from an incoherent noise, and the non-stationary component $\hat{\phi}_N^{(A)}(\omega, \tau)$ derived from an interference noise to calculate a post-filter $G(\omega, \tau)$ emphasizing the non-stationary component of the sound coming from the target area.

2. The signal processing apparatus according to claim 1, wherein the stationary component $\hat{\phi}_S^{(B)}(\omega, \tau)$ derived from an incoherent noise is a component obtained by smoothing the power spectrum density $\hat{\phi}_S(\omega, \tau)$ of the target area, the non-stationary component $\hat{\phi}_S^{(A)}(\omega, \tau)$ derived from a sound coming from the target area is a component obtained by removing the stationary component $\hat{\phi}_S^{(B)}(\omega, \tau)$ derived from an incoherent noise from the power spectrum density $\hat{\phi}_S(\omega, \tau)$ of the target area, and the non-stationary component $\hat{\phi}_N^{(A)}(\omega, \tau)$ derived from an interference noise is a component obtained by removing the component obtained by smoothing the power spectrum density $\hat{\phi}_N(\omega, \tau)$ of the noise area from the power spectrum density $\hat{\phi}_N(\omega, \tau)$ of the noise area.

3. The signal processing apparatus according to claim 1, wherein the second component extraction unit further extracts the non-stationary component $\hat{\phi}_N^{(A)}(\omega, \tau)$ derived from an interference noise from the power spectrum density $\hat{\phi}_N(\omega, \tau)$ of the noise area, the first component extraction unit, with $\alpha_S$ being a predetermined actual number, $Y_S$ being a set of indexes of frames for a predetermined interval, and $\beta_S(\omega)$ being a predetermined actual number, calculates $\hat{\phi}_S^{(A)}(\omega, \tau)$ and $\hat{\phi}_S^{(B)}(\omega, \tau)$ defined by a formula below to set $\hat{\phi}_S^{(A)}(\omega, \tau)$ thus calculated to the non-stationary component $\hat{\phi}_S^{(A)}(\omega, \tau)$ derived from a noise coming from the target area and set $\hat{\phi}_S^{(B)}(\omega, \tau)$ thus calculated to the stationary component $\hat{\phi}_S^{(B)}(\omega, \tau)$ derived from an incoherent noise, $$\tilde{\phi}_s(\omega, \tau) = \alpha_S \hat{\phi}_s(\omega, \tau) + (1 - \alpha_S)\tilde{\phi}_s(\omega, \tau - 1)$$

$$\hat{\phi}_s^{(B)}(\omega, \tau) = \min_{\tau \in Y_s} \{\tilde{\phi}_s(\omega, \tau)\}$$

$$\hat{\phi}_s^{(A)}(\omega, \tau) = \hat{\phi}_s(\omega, \tau) - \beta_S(\omega)\hat{\phi}_s^{(B)}(\omega, \tau)$$

the second component extraction unit, with $\alpha_N$ being a predetermined actual number, $Y_N$ being a set of indexes of frames for a predetermined interval, and $\beta_N(\omega)$ being a predetermined actual number, calculates $\hat{\phi}_N^{(A)}(\omega, \tau)$ and $\hat{\phi}_N^{(B)}(\omega, \tau)$ defined by a formula below to set $\hat{\phi}_N^{(A)}(\omega, \tau)$ thus calculated to the non-stationary component $\hat{\phi}_N^{(A)}(\omega, \tau)$ derived from an interference noise and set $\hat{\phi}_N^{(B)}(\omega, \tau)$ to the stationary component $\hat{\phi}_N^{(B)}(\omega, \tau)$ derived from an incoherent noise, $$\tilde{\phi}_N(\omega, \tau) = \alpha_N \hat{\phi}_N(\omega, \tau) + (1 - \alpha_N)\tilde{\phi}_N(\omega, \tau - 1)$$

$$\hat{\phi}_N^{(B)}(\omega, \tau) = \min_{\tau \in Y_N} \{\tilde{\phi}_N(\omega, \tau)\}$$

$$\hat{\phi}_N^{(A)}(\omega, \tau) = \hat{\phi}_N(\omega, \tau) - \beta_N(\omega)\hat{\phi}_N^{(B)}(\omega, \tau),$$

and the various noise responding gain calculation unit further uses the stationary component $\hat{\phi}_N^{(B)}(\omega, \tau)$ derived from an incoherent noise to calculate the post-filter $G(\omega, \tau)$ emphasizing the non-stationary component of the sound coming from the target area.

4. The signal processing apparatus according to claim 1, further comprising:

a time frequency averaging unit that performs smoothing processing in at least one of a time direction and a frequency direction with respect to the post-filter $G(\omega, \tau)$; and a gain shaping unit that performs gain shaping with respect to the post-filter $G(\omega, \tau)$ subjected to the smoothing processing.

5. A non-transitory computer readable recording medium in which a program for causing a computer to function as each unit of the signal processing apparatus according to claim 1 is stored.

6. A signal processing method comprising:

a local PSD estimation step of estimating each of a local power spectrum density of a target area and that of at least one noise area different from the target area based on an observation signal of a frequency domain obtained from a signal collected with M microphones forming a microphone array;

a target area/noise area PSD estimation step of estimating a power spectrum density $\hat{\phi}_S(\omega, \tau)$ of the target area and a power spectrum density $\hat{\phi}_N(\omega, \tau)$ of the noise area based on the estimated local power spectrum density, $\omega$ being a frequency and $\tau$ being an index of a frame;

a first component extraction step of extracting a non-stationary component $\hat{\phi}_S^{(A)}(\omega, \tau)$ derived from a sound coming from the target area and a stationary component $\hat{\phi}_S^{(B)}(\omega, \tau)$ derived from an incoherent noise from the power spectrum density $\hat{\phi}_S(\omega, \tau)$ of the target area;

a second component extraction step of extracting a non-stationary component $\hat{\phi}_N^{(A)}(\omega, \tau)$ derived from an interference noise from the power spectrum density $\hat{\phi}_N(\omega, \tau)$ of the noise area; and a various noise responding gain calculation step of using at least the non-stationary component $\hat{\phi}_S^{(A)}(\omega, \tau)$ derived from a sound coming from the target area, the stationary component $\hat{\phi}_S^{(B)}(\omega, \tau)$ derived from an incoherent noise, and the non-stationary component $\hat{\phi}_N^{(A)}(\omega, \tau)$ derived from an interference noise to calculate a post-filter $G(\omega, \tau)$ emphasizing the non-stationary component of the sound coming from the target area.

* * * * *